US009035630B2

(12) United States Patent
Krenzke

(10) Patent No.: US 9,035,630 B2
(45) Date of Patent: May 19, 2015

(54) OUTPUT TRANSISTOR LEAKAGE COMPENSATION FOR ULTRA LOW-POWER LDO REGULATOR

(75) Inventor: Rainer Krenzke, Esslingen (DE)

(73) Assignee: Dialog Semoconductor GmbH, Kirchheim/Teck-Nabern (DE)

( * ) Notice: Subject to any disclaimer, the term of this patent is extended or adjusted under 35 U.S.C. 154(b) by 401 days.

(21) Appl. No.: 13/443,920

(22) Filed: Apr. 11, 2012

(65) Prior Publication Data

US 2013/0265020 A1 Oct. 10, 2013

(30) Foreign Application Priority Data

Apr. 6, 2012 (EP) ..... 12368010

(51) Int. Cl.

| | |
|---|---|
| ***G05F 1/00*** | (2006.01) |
| ***G05F 3/20*** | (2006.01) |
| ***G05F 1/56*** | (2006.01) |
| ***G05F 3/30*** | (2006.01) |

(52) U.S. Cl.

CPC ... *G05F 1/56* (2013.01); *G05F 3/30* (2013.01)

(58) Field of Classification Search

USPC ..... 323/313–316, 268–275; 327/538–543

See application file for complete search history.

(56) References Cited

U.S. PATENT DOCUMENTS

| | | | | |
|---|---|---|---|---|
| 4,808,908 | A * | 2/1989 | Lewis et al. | 323/313 |
| 5,039,878 | A * | 8/1991 | Armstrong et al. | 327/512 |
| 5,391,980 | A * | 2/1995 | Thiel et al. | 323/314 |
| 5,559,425 | A * | 9/1996 | Allman | 323/315 |
| 6,016,051 | A * | 1/2000 | Can | 323/315 |
| 6,118,263 | A * | 9/2000 | O'Neill et al. | 323/315 |
| 6,144,250 | A * | 11/2000 | Owen et al. | 327/539 |
| 6,157,245 | A * | 12/2000 | Rincon-Mora | 327/539 |
| 6,175,224 | B1 * | 1/2001 | Kadanka | 323/281 |
| 6,198,266 | B1 * | 3/2001 | Mercer | 323/316 |
| 6,323,628 | B1 * | 11/2001 | Park | 323/281 |
| 6,366,071 | B1 * | 4/2002 | Yu | 323/316 |
| 7,030,598 | B1 * | 4/2006 | Dow | 323/313 |
| 7,084,698 | B2 * | 8/2006 | Khan et al. | 327/539 |
| 7,126,316 | B1 * | 10/2006 | Dow | 323/280 |
| 7,227,401 | B2 * | 6/2007 | Zhang et al. | 327/513 |
| 7,276,890 | B1 * | 10/2007 | Kumar | 323/313 |
| 7,362,081 | B1 | 4/2008 | Huang | |
| 7,595,627 | B1 * | 9/2009 | Mahnke et al. | 323/316 |

(Continued)

FOREIGN PATENT DOCUMENTS

| | | |
|---|---|---|
| EP | 1 965 283 | 9/2008 |
| WO | WO 2007/145068 | 12/2007 |

OTHER PUBLICATIONS

European Search Report, 12368010.0-1239, Mailed-Nov. 2, 2012, Dialog Semiconductor GmbH.

(Continued)

*Primary Examiner* — Timothy J Dole
*Assistant Examiner* — Yusef Ahmed
(74) *Attorney, Agent, or Firm* — Saile Ackerman LLC; Stephen B. Ackerman

(57) ABSTRACT

Circuits and methods to compensate leakage current of a LDO are disclosed. The compensation is achieved by a temperature dependent sink current generation, which has a nearly zero current consumption increase of about 50 nA at room temperature and starts sink current at temperatures about above 85 to 100 degrees Celsius, which is corresponding to a range of temperature wherein leakage currents come into account.

21 Claims, 3 Drawing Sheets

(56) References Cited

U.S. PATENT DOCUMENTS

| | | | | |
|---|---|---|---|---|
| 7,902,801 | B2 | 3/2011 | Mandal | |
| 7,902,912 | B2 * | 3/2011 | Marinca | 327/539 |
| 7,920,015 | B2 * | 4/2011 | Chellappa | 327/513 |
| 8,278,995 | B1 * | 10/2012 | Vu et al. | 327/539 |
| 8,749,220 | B2 * | 6/2014 | Hu et al. | 323/315 |
| 2003/0102851 | A1 * | 6/2003 | Stanescu et al. | 323/280 |
| 2004/0062292 | A1 * | 4/2004 | Pennock | 374/170 |
| 2004/0130378 | A1 | 7/2004 | Kihara | |
| 2005/0035812 | A1 * | 2/2005 | Xi | 327/539 |
| 2005/0248331 | A1 * | 11/2005 | Whittaker | 323/313 |
| 2006/0097805 | A1 * | 5/2006 | Bas et al. | 331/57 |
| 2007/0164812 | A1 * | 7/2007 | Rao et al. | 327/543 |
| 2007/0229158 | A1 * | 10/2007 | Mojarradi et al. | 330/253 |
| 2008/0203983 | A1 | 8/2008 | Lo Lacono et al. | |
| 2008/0284493 | A1 | 11/2008 | Baek et al. | |
| 2009/0058391 | A1 * | 3/2009 | Rokos | 323/313 |
| 2009/0108917 | A1 * | 4/2009 | Chellappa | 327/539 |
| 2009/0206919 | A1 * | 8/2009 | Imtiaz | 327/539 |
| 2009/0231031 | A1 * | 9/2009 | Moyer | 330/110 |
| 2009/0243713 | A1 * | 10/2009 | Marinca | 327/542 |
| 2009/0302822 | A1 * | 12/2009 | Chao et al. | 323/313 |
| 2009/0302823 | A1 * | 12/2009 | Chao et al. | 323/313 |
| 2010/0073070 | A1 * | 3/2010 | Ng et al. | 327/513 |
| 2010/0102794 | A1 * | 4/2010 | Erbito, Jr. | 323/313 |
| 2012/0094613 | A1 * | 4/2012 | Zhong et al. | 455/73 |

OTHER PUBLICATIONS

Patent Abstract of Japan, 2005011133, Jan. 13, 2005, Mitsumi Electric Co. Ltd.

* cited by examiner

OUTPUT TRANSISTOR LEAKAGE COMPENSATION FOR ULTRA LOW-POWER LDO REGULATOR

BACKGROUND (1) Technical Field

This disclosure relates generally to DC-to-DC converters and relates more specifically to linear regulators as e.g. low-dropout (LDO) regulators having an output transistor leakage current compensation.

(2) Description of the Prior Art

A low-dropout or LDO regulator is a DC linear voltage regulator, which can operate with a very small input-output differential voltage. The advantages of a low dropout voltage regulator include a lower minimum operating voltage, higher efficiency operation and lower heat dissipation. The main components of a LDO are an output power transistor (FET or bipolar transistor) and a differential amplifier (error amplifier). One input of the differential amplifier monitors the fraction of the output determined by a feedback voltage divider having a divider ratio. The second input to the differential amplifier is from a stable voltage reference (bandgap reference). If the output voltage rises too high relative to the reference voltage, the drive to the output power transistor changes to maintain a constant output voltage.

Usual LDO applications require source capability by using one output transistor only and therefore do have the usual LDO implementation a sourcing output transistor stage only. Any topology with sink-and-source capability will require a second output transistor and hence more silicon area and furthermore a corresponding control circuitry which will increase also the quiescent current consumption. The sink capability of a LDO with source transistor output stage is limited by its internal circuit current consumption. Especially for very low-power LDOs or low-power mode of LDO the current consumption of the internal circuitry is in the range of a few-uA or even far below 1 uA. Therefore is nearly no sink capability available.

If the LDO is operated at higher temperature, i.e. above 125 degrees Celsius, the leakage current of a big output transistor gets relevant and could exceed the sink capability. The result would be an increase of LDO output voltage, which could in worst-case jump up to the LDO input voltage and the regulation capability of the LDO will be completely lost.

In order to overcome this problem a voltage monitor and clamping circuitry could be used. The drawback of this solution is an additional current consumption by such circuitry, which is not really acceptable for ultra low-power designs. Another solution could be a LDO with source-sink output stage as mentioned above. Again, such output stage requires more complex control and hence have drawback on maintaining the loop stability for the whole circuitry and furthermore will cause additional current consumption as well.

A very simple solution could be to add a constant-current sink with a fix value of the maximum expected leakage current of the source output transistor. But this would again clearly increase the current consumption, even at room temperature.

It is a challenge for engineers designing LDOs to compensate leakage current efficiently, i.e. without additional power consumption or without complex control.

SUMMARY

A principal object of the present disclosure is to achieve a very low-power LDO with capability of stable operation at no output current load and of high temperature up to leakage current relevant ranges of about 150 degrees Celsius.

Another principal object of the disclosure is to minimize power consumption for output voltage protection of LDOs due to leakage current caused output voltage increase.

A further object of the disclosure is to prevent any output voltage increase of LDOs due to leakage current without requiring any overvoltage monitoring and clamping circuitry.

A further object of the disclosure is to prevent any output voltage increase of LDOs due to leakage current without requiring a complex sink-source output stage.

A further object of the disclosure is to prevent any output voltage increase of LDOs due to leakage current relying only on single source transistor.

A further object of the disclosure is to prevent any output voltage increase of LDOs due to leakage current without impacting topology of LDO regulation loop and loop compensation scheme and not to apply another regulation loop by the leakage current compensation circuitry.

In accordance with the objects of this disclosure a method to achieve leakage current compensation for an ultra low power LDO regulator without impacting topology of LDO regulation loop and loop compensation scheme has been achieved. The method comprises the following steps: (1) providing a LDO regulator and a PTAT type sink current generator, (2) deploying the PTAT type sink current generator on a same silicon and same chip as the LDO regulator, and (3) providing sink current by the PTAT type sink current generator as required to compensate leakage current of LDO pass transistor wherein the sink current and leakage current depend upon common junction temperature of both LDO and sink current generator.

In accordance with the objects of this disclosure a circuit of a PTAT type sink current generator used to achieve leakage current compensation for an ultra low power LDO regulator, wherein the LDO and the sink current generator are deployed on a same silicon and on a same chip has been achieved. The circuit invented firstly comprises: a port for a bias current wherein said port is connected to a first terminal of a switch which can activate/deactivate the sink current generator, said switch wherein the switch is controlled by a control voltage, that depends on a common junction temperature of the circuits of the LDO and the sink current generator, and a port for said control voltage, wherein said control voltage switches off all transistors which might cause power consumption while the junction temperature is below a threshold value. Furthermore the circuit invented comprises: a port for an output of the sink current generator, wherein said port is connected an output port of the LDO regulator: an arrangement of transistors forming a PTAT circuit wherein the PTAT circuit generates a PTAT current wherein the PTAT current and the leakage current depend upon the junction temperature, and an arrangement of current mirrors to scale down the PTAT in order to achieve a sink current suitable to compensate a leakage current of the pass transistor of the LDO.

BRIEF DESCRIPTION OF THE DRAWINGS

In the accompanying drawings forming a material part of this description, there is shown.

DETAILED DESCRIPTION

Methods and circuits for very low power LDOs with capability of stable operation at no output current load and high temperature up to leakage current relevant ranges of about 150 degrees Celsius are disclosed. The complete current consumption of the LDO invented is in the range of 1 uA to 2 uA at room temperature.

The disclosure can be applied to all LDOs with just source output. In case of source/sink output stage the problem of leakage currents would be already inherently solved. Considering single output device type LDOs it will be applicable for either FET or bipolar output and either PMOS/NMOS or PNP/NPN types.

Figure 1:
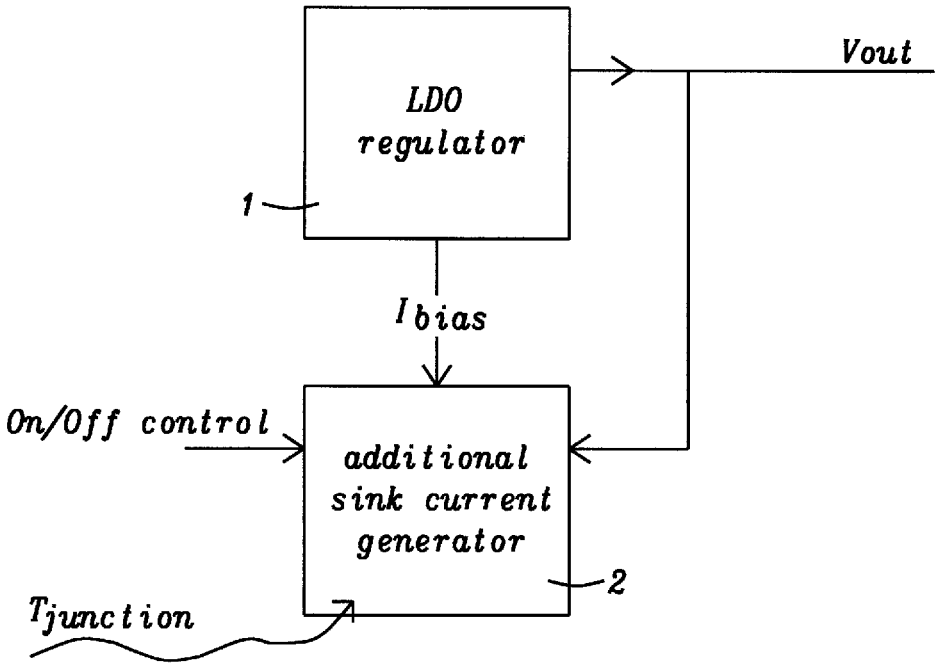
FIG. 1 shows a basic block diagram of the main components of the circuit invented.

FIG. 1 shows a basic block diagram of the main components of the circuit invented. Tjunction is the maximum junction temperature of a transistor. The LDO regulator 1 is a usual LDO regulator. Furthermore an additional PTAT sink current generator 2 is shown. This circuit 2 maintains a sink current generation dependent on junction temperature. It has no or nearly zero current consumption on room temperature and a relevant sink current at high junction temperatures, i.e. in the range between 125 degrees Celsius and 150 degrees Celsius. The sink current is easily scalable adopt for different output transistor sizes, i.e. different leakage current values, which are also dependent upon transistor sizes. The circuit 2 is connected to the LDO output node.

The circuit 2 needs dedicated current biasing to maintain a defined sink current level. The biasing current could be derived either by a usual LDO current biasing or by an own bias current generation but looks it would be more efficient to use an already existing bias current supply for the LDO.

A junction temperature (Tj) dependent sink current generator is provided by circuit 2, which is a "proportional-to-absolute-temperature" (PTAT) type circuit. The output transistor of the sink current generator circuit 2 can be either a NMOS transistor or a bipolar transistor. The output transistor can be used to mirror-out the PTAT current with any factor m and thereby the sink current value can be easily scaled.

A well-defined bias current, which is usually available on the LDO and sufficiently mirrored down to a few $10^{th}$ nA, i.e. 50 nA, could be used to provide a very low current at room temperature. In case the "On/Off" control of circuit 2 is derived from an existing temperature comparator on the chip the sink current generator circuit 2 could be switched off at temperatures below a defined high-temperature threshold, thus achieving zero-current consumption at room temperature. Only for the high temperature range, e g. a range between 125 degrees and 150 degrees Celsius, the sink current generator circuit 2 is switched ON as only in this junction temperature range the operation of the sink current generator circuit 2 is required because leakage currents are starting in this junction temperature range, especially with a large output transistor device which is implemented on the same silicon and chip. Therefore the output transistor has the same junction temperature as the sink current generator circuit 2.

Figure 2:
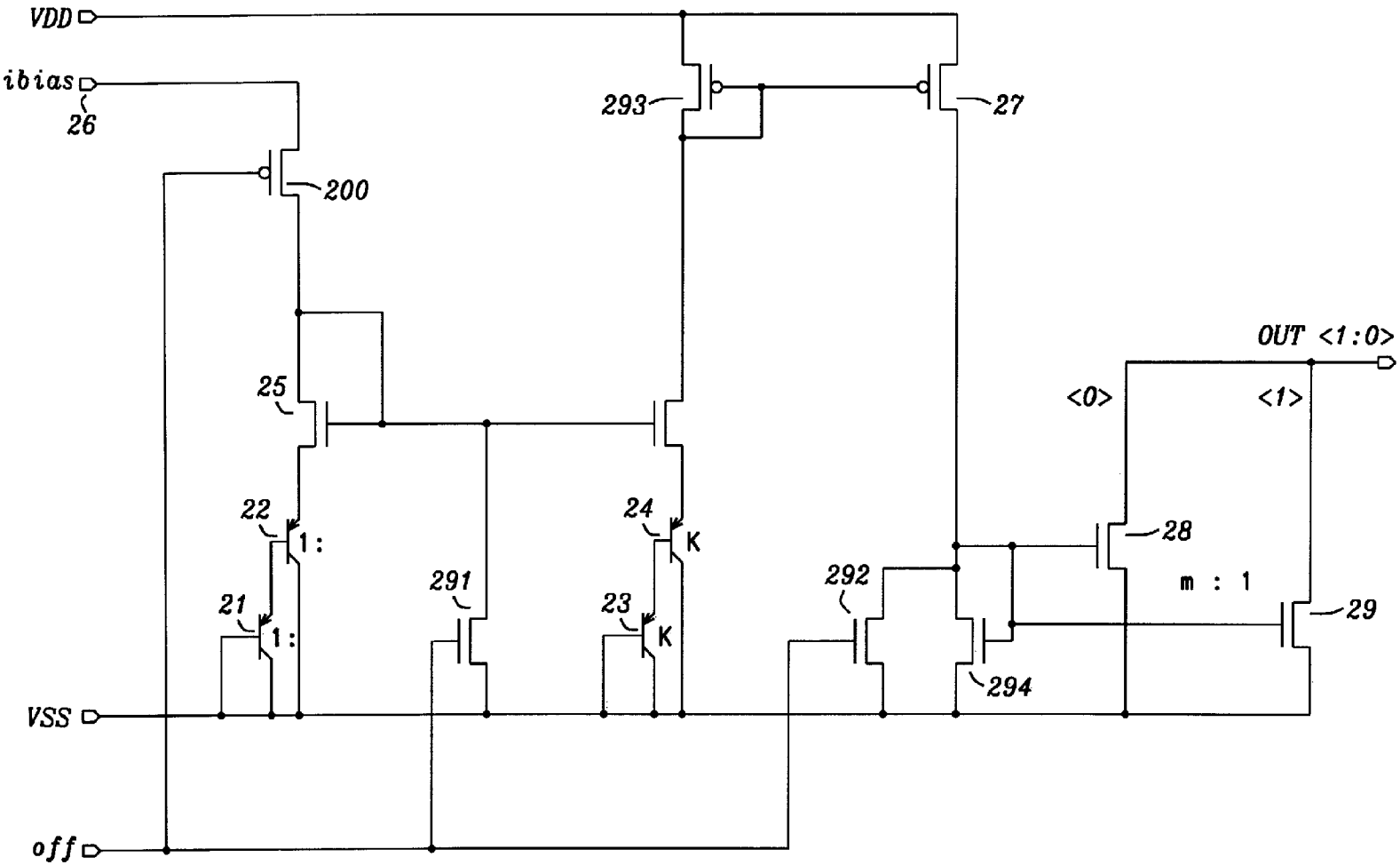
FIG. 2 shows circuit diagram a preferred embodiment of the PTAT sink current generator.

FIG. 2 shows circuit diagram a preferred embodiment of the disclosure of the PTAT sink current generator 2.

In the preferred embodiment bipolar transistors 21-24 together with NMOS transistor 25 form a PTAT circuit, i.e. generating a current dependent upon the junction temperature of the silicon the circuit is deployed on. The bipolar transistors 21-24 can be single transistors or stacked together. The stacked bipolar transistor configuration improves the PTAT behavior with respect to a required ratio of bipolar transistors 21 and 22 to 23 and 24, wherein bipolar transistor 21 has a ratio to transistor 23 of 1:k, and bipolar transistor 22 has the same ratio of 1:K ratio to transistor 24, wherein K is a number of higher than 1. There needs usually to be implemented a ratio of 1:k between the bipolar transistors of input branch 21 (and 22 if used) and mirrored branch transistor 23 (and 24 if used). This factor is often chosen in the range of a value of 2 to 4. To better maintain the PTAT current generation without too big transistor dimensions there could be also used transistor 25 as an isolated NMOS transistor in a deep nwell/pwell.

It should be noted that alternatively other arrangements of transistors forming a PTAT circuit could be used as well.

Defined current biasing of e.g. 50 nA is provided via port 26. The port off provides a voltage to switch off the PTAT type sink current generator in a way that zero power is consumed, e.g. via the gate of transistor 200 the bias current is blocked. The voltage of port off is activated while the junction temperature is below a threshold and hence no leakage compensation is required. Furthermore the gates of transistors 291 and 292 are connected to the voltage of port off and both transistors switch off if the voltage of port off is activated.

The PTAT-current is mirrored out by transistor 27, which is a part of a current mirror formed by transistors 293 and 27, and following transistors. Transistors 28 and 29 build a quasi-binary scaling of sink current. Unused outputs can be shorted to VSS voltage and don't contribute to sink current value then.

Binary scaling of the sink current can be achieved by transistor 28 and 29 current mirror ratios. If transistor 28 has a ratio of e.g. 1 and transistor 29 a ratio of m=2 in relation to left side branch transistor NMOS transistor 294 it would generate an output PTAT current of 1*i(27)+2*i(27) wherein i(27) is the current through transistor 27. This is a binary scaling as being the first 2 coefficients of the power 2 series (2 power of 0=1, and 2 power of 1=2). If the two outputs OUT<1:0> are used in different configurations of LDO output drive transistor and hence different leakage currents, it could be used as sink capability of either 1*i(27) means OUT<0> or 2*i(27) means OUT<1> or 1*i(27)+2*i(27) means both OUT<1:2> together.

This is like a binary scheme. Each unused output of OUT<> will be shorted to VSS voltage level or could be even left floating. (floating nodes is often not this good design style but would functional wise not harm anything.

Figure 3:
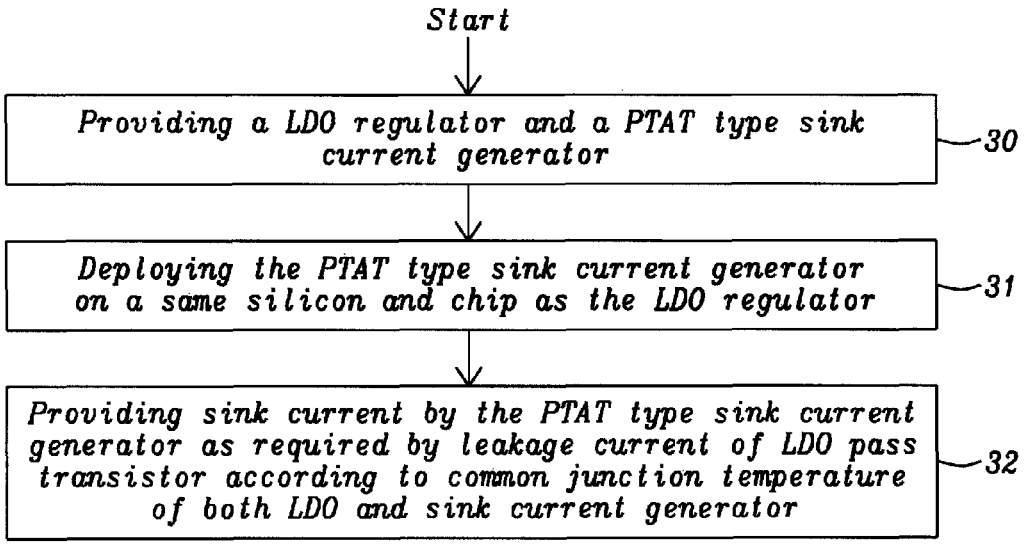
FIG. 3 illustrates a flowchart of a method invented to achieve leakage current compensation for an ultra low power LDO regulator.

FIG. 3 illustrates a flowchart of a method invented to achieve leakage current compensation for an ultra low power LDO regulator. Step 30 of the method of FIG. 3 illustrates the provision of a LDO regulator and a PTAT type sink current generator. Step 31 depicts deploying the PTAT type sink current generator on a same silicon and chip as the LDO regulator. Step 32 illustrates providing sink current by the PTAT type sink current generator as required by leakage current of LDO pass transistor according to common junction temperature of both LDO and sink current generator.

In summary key items of the disclosure are:

- temperature dependent sink current generation, which maintains to have nearly-no-current consumption increase (only in the range of a few $10^{th}$ of nA) at room temperature (RT) and starts generating sink current at higher temperature above 100 degrees C. (where leakage currents get usually into account)
- no overvoltage monitoring and clamping circuitry needed for leakage-caused output voltage increase protection and hence saving of corresponding current consumption of such circuitry.

no circuitry for sink current generation, which impacts regulation loop and/or changes LDO regulator topology.

sink current generation scalable with output transistor size to maintain different leakage current values While the disclosure has been particularly shown and described with reference to the preferred embodiments thereof, it will be understood by those skilled in the art that various changes in form and details may be made without departing from the spirit and scope of the disclosure.

What is claimed is:

1. A method to achieve leakage current compensation for an ultra low power LDO regulator without impacting topology of LDO regulation loop and loop compensation scheme, comprising the following steps:

(1) providing a LDO regulator and a PTAT type sink current generator;

(2) deploying the PTAT type sink current generator on a same silicon and same chip as the LDO regulator, wherein the PTAT type sink current generator comprises a port for a bias current and a port for a control voltage, wherein said control voltage is configured to switch off via a switch all transistors that might cause power consumption while the junction temperature is below a threshold; and (3) providing sink current by the PTAT type sink current generator as required to compensate leakage current of LDO pass transistor, wherein the sink current and leakage current depend upon common junction temperature of both LDO and sink current generator and wherein the output voltage of the LDO is independent of leakage current.

2. The method of claim 1 wherein further providing a bias current from the LDO for the PTAT type sink current generator, wherein the bias current has to be defined to maintain a defined current sink level.

3. The method of claim 2 wherein the bias current is mirrored down to a very small current level of about 50 nA.

4. The method of claim 1 wherein further providing a bias current from a bias current generator for the PTAT type sink current generator, wherein the bias current has to be defined to maintain a defined current sink level.

5. The method of claim 1 wherein the sink current is scalable with LDO pass transistor size, wherein the leakage current of the pass transistor depends also on the size of the pass transistor.

6. The method of claim 1 wherein the PTAT type sink current generator has an ON/OFF control dependent on the junction temperature wherein the PTAT type sink current generator is switched on when the junction temperature has reached such a level that causes a relevant leakage current of the pass transistor and the sink current generator is switched off when the junction temperature is below this level, thus enabling zero power consumption.

7. The method of claim 1 wherein an arrangement of current mirrors allow binary scaling of the sink current.

8. The method of claim 1 wherein unused outputs can be shortened and don't contribute to sink current value.

9. A circuit of a PTAT type sink current generator used to achieve leakage current compensation for an ultra low power LDO regulator, wherein the LDO and the sink current generator are deployed on a same silicon and on a same chip, comprising:

a port for a bias current wherein said port is connected to a first terminal of a switch which can activate/deactivate the sink current generator;

said switch wherein the switch is controlled by a control voltage, which depends on a common junction temperature of the circuits of the LDO and the sink current generator;

a port for said control voltage, wherein said control voltage is configured to switch off all transistors that might cause power consumption while the junction temperature is below a threshold value;

a port for an output of the sink current generator, wherein said port is connected an output port of the LDO regulator;

an arrangement of transistors forming a PTAT circuit wherein the PTAT circuit is capable of generating a PTAT current wherein the PTAT current and the leakage current depend upon the junction temperature; and an arrangement of current mirrors configured to scale down the PTAT current in order to achieve a sink current suitable to compensate a leakage current of the pass transistor of the LDO preventing any output voltage increase of the LDO due to leakage current of the pass transistor.

10. The circuit of claim 9 wherein unused outputs of the sink current generator can be shorted to VSS voltage and do not contribute to sink value then.

11. The circuit of claim 9 wherein an output transistor of the sink current generator circuit can be either a NMOS transistor or a bipolar transistor.

12. The circuit of claim 9 wherein said bias current is derived from a current of the LDO.

13. The circuit of claim 9 wherein said arrangement of transistors forming a PTAT circuit comprises bipolar transistors (stacked or just single one) together with NMOS transistors in a current mirror configuration wherein a current generated by the PTAT circuit rises as a junction temperature rises.

14. The circuit of claim 9 wherein said arrangement of transistors forming a PTAT circuit comprises a first bipolar transistor having a collector and a base connected to VSS voltage and an emitter connected to a base of a second bipolar transistor;

said second bipolar transistor having an emitter connected to a source of a first NMOS transistor and a collector connected to VSS voltage;

said first NMOS transistor having a gate and a drain connected to a drain of a PMOS transistor switch;

said PMOS transistor switch having a gate connected to the port of said control voltage and a source connected to the port of said bias current:

a third bipolar transistor having a collector and a base connected to VSS voltage and an emitter connected to a base of a fourth bipolar transistor; and said fourth bipolar transistor having an emitter connected to a source of a second NMOS transistor and a collector connected to VSS voltage.

15. The circuit of claim 14 wherein sizes of said first and said third bipolar transistor have a relationship of 1:K, wherein K is a number of higher than 1.

16. The circuit of claim 14 wherein sizes of said second and said fourth bipolar transistors have a relationship of 1:K, wherein K is a number of higher than 1.

17. The circuit of claim 14 wherein said first NMOS transistor and said second NMOS transistor form a current mirror.

18. The circuit of claim 9 wherein an arrangement of current mirrors allows binary scaling of the sink current.

19. The circuit of claim 18 wherein said binary scaling is used to achieve different configurations of sizes of the output drive transistor and hence different leakage current.

20. The circuit of claim 18 wherein the arrangement of current mirrors comprises:

a third NMOS transistor, wherein the PTAT circuit is flowing through, having a source connected to VSS voltage and a gate is connected to gates of a fourth NMOS transistor and of a fifth NMOS transistor;

said fourth NMOS transistor having a source connected to VSS voltage and a drain connected to the output port of the sink current generator; and said fifth NMOS transistor having a source connected to VSS voltage and a drain connected to the output port of the sink current generator.

21. The circuit of claim 20 wherein relations of sizes of said third, fourth, and fifth NMOS transistors allow binary scaling of the output current of the sink current generator.

* * * * *